US007708246B1

(12) United States Patent
Trask

(10) Patent No.: US 7,708,246 B1
(45) Date of Patent: May 4, 2010

(54) RETICULATED CAM ACTUATOR

(76) Inventor: Brian C. Trask, 3601 E. Hermes Dr., Salt Lake City, UT (US) 84124

( * ) Notice: Subject to any disclaimer, the term of this patent is extended or adjusted under 35 U.S.C. 154(b) by 1217 days.

(21) Appl. No.: 11/222,727

(22) Filed: Sep. 9, 2005

Related U.S. Application Data

(60) Provisional application No. 60/608,487, filed on Sep. 9, 2004.

(51) Int. Cl.
*A47L 3/04* (2006.01)

(52) U.S. Cl. ..... 248/231.9; 248/925; 182/3

(58) Field of Classification Search ..... 248/231.9, 248/925; 182/3; 81/53.12
See application file for complete search history.

(56) References Cited

U.S. PATENT DOCUMENTS 6,283,426 B1 * 9/2001 Guthrie et al. ..... 248/231.9
6,474,441 B1 * 11/2002 Bertolino ..... 182/3
6,640,667 B1 * 11/2003 Pomerantz ..... 81/53.12
6,810,994 B2 * 11/2004 Trask ..... 182/3
7,014,156 B2 * 3/2006 Apezetxea et al. ..... 248/231.9

* cited by examiner

*Primary Examiner*—Anita M King
(74) *Attorney, Agent, or Firm*—Brian C. Trask

(57) ABSTRACT

An actuator device operable to retract the cam elements of a spring-loaded camming device (SLCD) used in the sport of rock climbing. The actuator includes a remote finger and a remote thumb. The remote finger is mounted in a handle to permit translation of the remote finger along an axis, and rotation of the remote finger about that axis. In use, the remote finger can be rotated to present a narrow profile to pass between the trigger bar of a SLCD and a wall of a crack. Subsequent to its insertion behind the trigger bar, the remote finger can be rotated by about 90 degrees to capture the trigger bar. Then, the remote finger and remote thumb can be urged toward each other, effective to squeeze the SLCD and rotate its cam elements, to effect removal of the SLCD from the confines of the crack.

18 Claims, 4 Drawing Sheets

316
314
316
318
308
304
310

316
314
314
318
316
304
310
308

312
302
312
310
312
302
310
320
306
306
300
6
6
304

302

308

306

304
302
308

RETICULATED CAM ACTUATOR

RELATED APPLICATIONS

This application claims the benefit under 35 U.S.C. 119(e) of the filing date of Provisional Application Ser. No. 60/608,487, filed Sep. 9, 2004, for "RETICULATED ACTUATOR", the disclosure of which is hereby incorporated by reference as though set forth herein in its entirety.

BACKGROUND

1. Field of the Invention

This invention relates to equipment used in the sport of rock climbing. It is particularly directed to spring loaded camming devices used in such rock climbing, and provides an enhanced cam actuating mechanism.

2. State of the Art

Spring loaded camming devices (SLCDs), or commonly "cams", are advantageously used in the sport of rock free-climbing as a source of leader protection for cracks having substantially parallel sides. In a typical climbing scenario, SLCDs are temporarily placed by a leading climber into cracks as protection, and clipped to a rope attached to the leading climber, as the leading climber advances up a rock face. A following climber generally "cleans", or removes such protection from the crack.

At times, SLCDs placed into cracks may "walk" under the action of friction from the rope as a climber is climbing. In such circumstance, the camming device may move deeper into the crack from the initial placement location. It is not uncommon for a SLCD to walk, from an original placement location, deeper into a crack until its trigger is contained inside the crack.

It is possible for a walking SLCD to work its way (or even to be placed by the leading climber), sufficiently deep inside a crack that a following climber may be unable to retrieve it with his/her hand. Two situations commonly arise which create cam retrieval difficulty: either the cleaning climber's hand/fingers cannot engage the trigger due to crack constriction, or the camming device is too deep for the climber to reach. Sometimes, the crack is simply too narrow to admit passage of the follower's fingers to a sufficient depth. In a crack that is slightly less narrow, the follower's fingers still may not have sufficient room to pass between the trigger of the SLCD and a wall of the crack. If the climber's fingers cannot get a purchase on the SLCD's trigger, the SLCD can be very difficult to remove from the crack.

A dedicated cam actuating and retrieving device has been commercially available under the name "Friend of a friend", and is indicated generally at 100 in FIG. 1. This device 100 has an actuator arranged somewhat similar to a syringe, and has a fixed length of perhaps about 8-10 inches in its stowed (compact) position. The "fingers" 102 are formed from the tubular metal body 104, and are therefore fixed in position to cooperate with the "thumb" 106. Such fixed fingers 102 cannot be placed into retracting engagement on a trigger of an SLCD that is in a narrow crack (e.g. a crack that is about ⅜ to ⅝ inches in width, or so), because the fingers 102 have a fixed height "H", which cannot be inserted into the crack to pass between the SLCD's trigger and a wall of the crack.

Nut cleaning tools are also sometimes used as an aid to retrieve cams which are unreachable by hand. A representative nut cleaning tool is indicated generally at 110 in FIG. 2. Such nut cleaning tools 110 may be formed from steel sheet metal of about 10 gage, or so. Nut cleaning tools generally have a hook 112 which may be used to snag a SLCD's trigger.

However, it can be difficult to coordinate pulling on the nut tool while simultaneously pushing on the stem of the SLCD to cause the individual cam lobes to rotate. Furthermore, the hook 112 typically engages the trigger of the stuck SLCD effective only to actuate a single cam element, or perhaps a pair of cam elements. Therefore, the remaining (and unretracted), cam elements of the SLCD can resist removal of the SLCD from the crack.

A need exists for a tool to assist in retrieving cams which become wedged too deep in a crack for a climber to remove either by hand or with the assistance of a commercially available device. It would be an advance to provide a cam actuating tool capable of actuating a cam in even a very narrow crack. It would be a further advancement if such tool provided the ability to place and remove a cam at an extended distance compared with available devices.

BRIEF SUMMARY OF THE INVENTION

Embodiments of the invention may be regarded as being reticulated, in that one or more translatable and rotatable remote fingers operates in harmony as a network or system with a remote thumb to apply a compressive force to an object disposed between the finger and thumb. Preferred embodiments of the invention are operable to obtain a grip on structure that is located in a narrow confine, such as in a crack, hole, or crevice. In use of the invention, a remote finger can be rotated out-of-plane, extended to bypass an object, then rotated back into-plane and retracted to urge the object toward a remote thumb. The object can then be gripped and manipulated, e.g. removed from a crevice. Rotation of the remote finger can enable the remote finger to pass between the object and a wall of a narrow confine by orienting the remote finger to fit in the available bypass space between the object and wall.

The present invention provides an apparatus particularly adapted for actuating spring-loaded camming devices (SLCDs) used in the sport of rock climbing. Embodiments of reticulated actuators structured according to the invention are operable to actuate and extract deeply located SLCDs in many cases. Actuating an SLCD involves retracting its trigger to cause individual cam lobes of the SLCD to rotate, and thereby present a reduced size for placement and/or extraction of the SLCD with respect to a crack. Preferred embodiments constructed according to principles of the invention are adapted to assist in retracting the trigger of a SLCD. Of course, a reticulated actuator structured according to certain principle of the instant invention may be used in other applications that benefit from rotating a remote finger out-of-plane and extending the remote finger to bypass structure to be gripped between the restored in-plane finger and a remote thumb.

One embodiment of the invention includes a retraction mechanism and a control interface adapted to operate the retraction mechanism. An operable retraction mechanism includes a first remote finger arranged to cooperate with a remote thumb. The first remote finger is arranged to translate along a first axis to cause a variable spacing between the first remote finger and the remote thumb. The first remote finger is also adapted to permit its rotation about the first axis. Currently preferred embodiments of the invention also include a second remote finger disposed to translate along a second axis disposed substantially in parallel with the first axis such that a second variable spacing may be established between the second remote finger and remote thumb. The first and second variable spacings may be independently adjusted, or may be slaved together. Preferably, the second remote finger is also adapted to permit its rotation about the second axis. Rotation of the remote fingers may be independent, or may be slaved together.

An operable control interface is adapted to receive input from a human hand effective to cause the variable spacing between a remote finger and remote thumb. One operable control interface includes a trigger connected by a linkage to a remote finger. Movement of such trigger causes a corresponding motion of the remote finger. Certain operable triggers can be rotated through an angle of about 90 degrees. Currently preferred triggers can be rotated through an angle of about 180 degrees. A representative control interface used in a reticulated actuator for extracting SLCDs typically can cause up to about 4 inches to 6 inches of translation of the remote finger(s).

It is currently preferred for a remote finger to have a length and a width orthogonal to its length, with the width being smaller in size than the length. Therefore, the remote finger can be rotated about its translation axis such that the remote finger presents a reduced size to enhance its passage between the item and a wall of a crevice. Once the remote finger has been inserted deeper inside the crevice than the item to retrieve, the remote finger can be rotated and retracted effective to capture the item between the remote finger and remote thumb.

Certain embodiments of the invention may be characterized as including a handle having first and second ends spaced apart along a length axis, with pushing structure being associated with the first end. The handle also desirably includes an arm keeper and a remote thumb associated with the second end. A first retractor arm can be disposed in harmony with the arm keeper operably to permit displacement of the first retractor arm in a direction along a first slide axis disposed substantially parallel to the handle's length axis, and to permit rotation of the first retractor arm about the first slide axis. A first trigger is operably associated with a first end of the first retractor arm and a first remote finger is associated with a second end of the first retractor arm effective to couple motion of the first trigger to motion of the first remote finger. The assembly is configured and arranged to permit manipulation of the first trigger and pushing structure by way of human hand input operably to rotate and displace the first remote finger relative to the remote thumb.

Preferably, the arm keeper is adapted to resist rotation of the first retractor arm about first and second orthogonal Cartesian axes, and to permit rotation of the first retractor arm about a third Cartesian axis disposed orthogonal to the first and second Cartesian axes and substantially in parallel with the handle's length direction. Also it is desirable for the arm keeper to resist displacement of the first retractor arm along the first and second Cartesian axes, and to permit displacement of the first retractor arm along the third Cartesian axis.

Certain embodiments structured according to principles of the invention include a second retractor arm disposed in harmony with the arm keeper operably to permit displacement of the second retractor arm in a direction along a second slide axis disposed substantially parallel to the handle's length axis, and to permit rotation of the second retractor arm about the second slide axis. A second trigger is operably associated with a first end of the second retractor arm and a second remote finger is associated with a second end of the second retractor arm effective to couple motion of the second trigger to motion of the second remote finger. Such devices are typically configured and arranged to permit manipulation of the second trigger and pushing structure by way of human hand input operably to rotate and displace the second remote finger relative to the remote thumb.

Certain embodiments of the invention may be configured to fold, or otherwise be reduced in length, for transport. Desirably, devices structured according to principles of the instant invention and used in the sport of rock climbing have an overall stowed length of less than about 20 inches. Such devices may have a deployed length of about twice their stowed length, or more.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Reference will now be made to the drawings in which the various elements of the illustrated embodiments will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
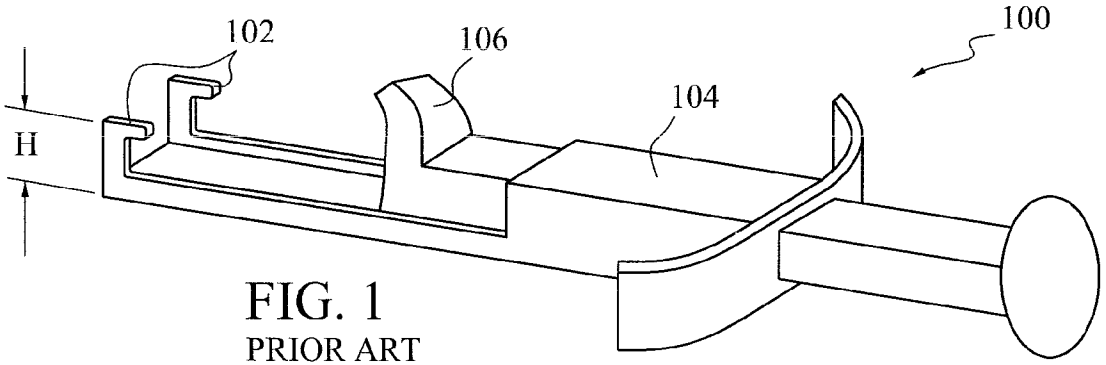
FIG. 1 PRIOR ART
FIG. 1 is view in perspective of a prior art cam-actuating device.
Figure 2:
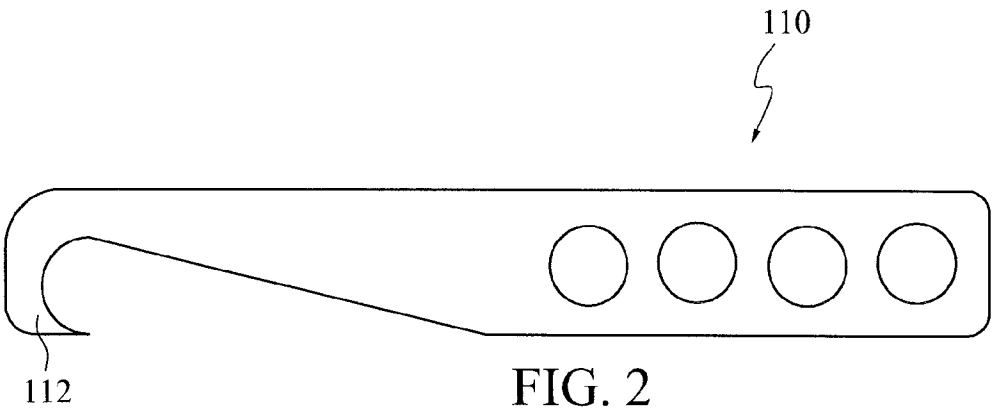
FIG. 2 PRIOR ART
FIG. 2 is a plan view of a prior art nut tool that can be used in a pinch to actuate the trigger of an SLCD.
Figure 3:
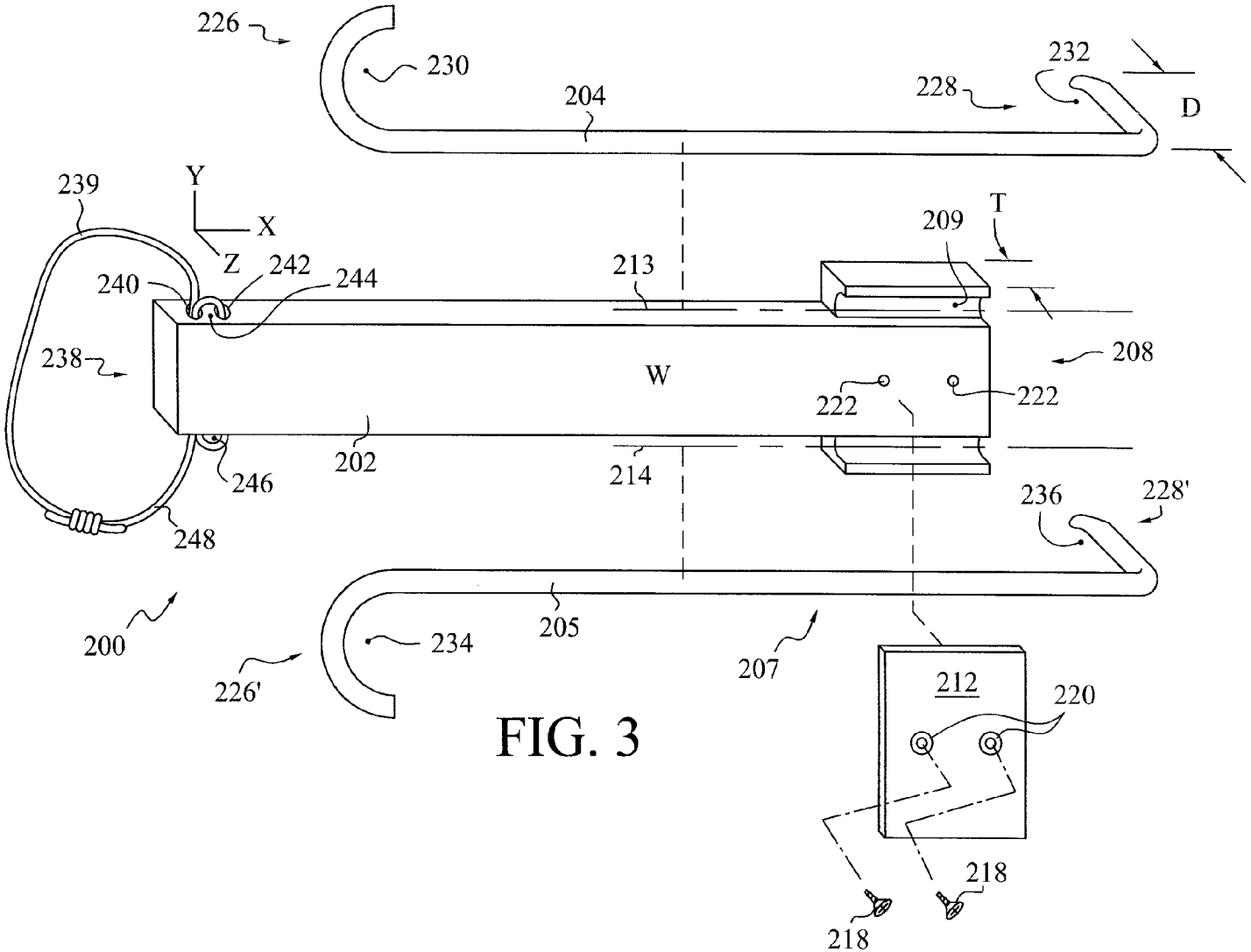
FIG. 3 is an exploded assembly view in perspective of a currently preferred embodiment of the invention.

As illustrated in FIG. 3, a currently preferred embodiment of the invention, generally indicated at 200, includes a handle 202, a pair of retractor arms 204, 205, and arm keeper structure generally indicated at 207. A handle 202 can be formed from any material, such as wood, metal, etc., that is sufficiently stiff to resist a compressive load generated in operation of the device 200. Such compressive load is transferred between a proximal end of the handle 202 and a remote thumb disposed at a distal end of handle 202, and generally indicated at 208. A workable thumb provides a surface against which a stem of a SLCD can be pressed. Sometimes, thumb 208 may include socket structure, or a textured surface, or other structure arranged to resist slipping of the SLCD's stem as the SLCD is actuated.

Embodiments of the invention typically include an arm keeper 207 effective to help guide a retractor arm for convenient manipulation of its remote finger. Illustrated arm keeper 207 includes a pair of axially elongated sockets 209 in which arms 204 and 205 are captured by plate 212. An installed retractor arm 204 is free to translate along, and rotate about, axis 213. Similarly, an installed retractor arm 205 is free to rotate about, and translate along, axis 214. Axis 213 is disposed substantially parallel to axis 214, and these axes are spaced apart by a distance indicated at "W". Desirably, axes 213 and 214 are also disposed substantially in parallel with a length axis of handle 202.

Plate 212 may be affixed to handle 202 by way of one or more fasteners 218, or by way of any other appropriate and well known construction technique. It is currently preferred to install a pair of such fasteners 218 through countersunk holes 220 and holes 222 for robust redundancy and to resist rotation of plate 212 with respect to handle 202. An operable plate 212 may be formed from a section of sheet metal, with stainless steel being currently preferred. However, other materials, including ferrous and nonferrous metals, plastics, and the like, can be used as well. In general, the plate 212 may be made from any material having sufficient structural properties to maintain the retractor arms 204, 205 in an alignment with respect to the handle 202. Desirably, the thumb 208 (including its installed plate 212) has a total thickness "T" of less than about ¾ inches, or even less than about ½ inch, to permit inserting the assembled remote thumb into thin crevices.

A representative retractor arm, such as arm 204, includes a trigger 226 disposed at a proximal end and a remote finger 228 disposed at a distal end. The trigger 226 forms a space 230 structured to receive a user's finger for manipulation of the remote finger 228. The remote finger 228 is structured to form a space 232 in which to capture the actuation trigger of a SLCD. As illustrated, trigger 226 of the preferred embodiment 200 is arranged to define finger space 230 oriented approximately in an x-y plane, where the x axis is oriented along the length direction of the handle 202. The capture space 232 is desirably oriented approximately in an x-z plane, as illustrated. It is desirable to orient the finger space 230 and capture space 232 substantially orthogonal to each other to facilitate operation of the device 200, and to provide a convenient and compact stowed configuration of the device 200. Similarly, it is desirable for finger receiving space 234 of arm 205 to be disposed approximately in an x-y plane as illustrated, and for capture space 236 to be disposed approximately in an x-z plane.

Arms 204 and 205 are illustrated in an orientation representative of a deployed retraction position. In such position triggers 226, 226' and pushing structure, generally indicated at 238, may be operated similarly to a syringe. As illustrated, triggers 226, 226' may be characterized as flaring away from the handle 202. Operable pushing structure 238 provides a surface against which to engage a user's thumb or palm. In such deployed retraction position, triggers 226 and 226' are oriented approximately in, or parallel to, the same plane to permit convenient retraction by selected ones of the user's fingers. Triggers 226 and 226' can be individually retracted to separately control the spacing between each of fingers 228 and 228' and remote thumb 208. Rotation of triggers 226, 226' can also be separately adjusted. However, it is within contemplation to configure arms 204 and 205 to slave either, or both, of translation and rotation of fingers 228, 228' together.

It is convenient to provide structure arranged to hold arms 204, 205 in a stowed (compact) position. One workable arm retaining structure includes a string lanyard 239 arranged as a figure "8", with one loop of the "8" passing through both of holes 240 and 242. Arms 204, 205 can be rotated to place triggers 226, 226' parallel to the sides of body 202, and with trigger structure disposed between the holes 240, 242. Each of the loops 244, 246 of string stretching between holes 240, 242 on each side of body 202 can then be entrained about a cooperating trigger, and snugged tight to capture the respective triggers against the body 202. The free loop 248 of the lanyard can then be used to clip the device 200 to a climber's rack or harness using a carabiner.

Desirably, at the stowed position, remote fingers 228, 228' are disposed in a stowage position effective to resist snagging the remote fingers on items during transport of the device 200. One operable stowage configuration locates the fingers in a socket structure provided by remote thumb 209.

Remote fingers 228, 228' are configured to provide sufficient length indicated at "D" to capture the triggers of a range of commercially available SLCDs. A workable length is about ½ inch, or so. Desirably, the finger length "D" is sized in harmony with the spacing "W", so that the fingers 228, 228' can be rotated to point at each other in the stowed position, with the triggers being substantially flat against the sides of body 202. Desirably, a spacing between adjacent retractor arms is determined in conformance with a spacing between structural members (or cam actuating cables), of a variety of SLCDs that are commercially available. Such spacing between arms positions an extended pair of remote fingers for rotating into contact with the structural members (or cam actuating cables), and helps to hold the SLCD securely in the device for manipulation of the SLCD inside the crevice. Such configuration also facilitates placing first one, and then the second remote finger, into proper holding position with respect to the trigger of the SLCD. A workable spacing "W" between arms 204, 205 is between about ½" and 1½", or larger. It has been determined that a spacing "W" of about 1 inch, or so, is adequate to permit the device 200 to interface with most, if not all, commercially available SLCDs.

A workable overall stowed length of a representative device 200 is about 10 to 12 inches, more or less. Desirably the stowed length is less than about 20 inches. It is within contemplation also to provide a reticulated retractor having a variable length that may be determined by a user in the field. Therefore, certain embodiments may include a hinged body and arms to permit folding the device for more convenient transport.

Arms 204, 205 are typically made from wire stock, such as from a steel rod of about ⅛ inch in diameter. Illustrated arms 204, 205 are simply bent to shape, although multipiece arms are within contemplation. Remote fingers 228, 228' may also include hook-like tips, as illustrated, or pointy tips to assist in capturing the trigger of a SLCD. It is preferred to form arms 204, 205 from stainless steel material, to resist rust and corrosion. Arms 204, 205 can be made from other materials as well, so long as the material provides sufficient resistance to bending to permit actuation of stubborn SLCDs.

It is currently preferred to injection mold a handle 202 from a plastic or plastic-like material, such as Nylon, ABS, PVC, polyurethane, rubber, TEFLON™, and the like. Desirably, handle material is sufficiently tough to stand up to scraping, banging, and general knocking about against rocks, both during its use and when stowed on a climber's rack or harness. Handle 202 advantageously can include rib structure (not illustrated) configured to reduce its weight and amount of required constituent material. It is further within contemplation to form handle 202 in a straight-pull mold, including a first hinged section at the lanyard end and a second hinged section (structured as an alternative to plate 212) at the arm keeper end. Such hinged sections may be "folded", with each folded section being secured to the bulk of handle 202 by way of one or more fasteners. The first mentioned folding section can be structured to define the lanyard holes and (optionally, if desired) simultaneously capture (to install) a lanyard. The second folding section can be structured to capture arms in sockets 209. Of course, the respective sections do not have to be hinged from the bulk of the handle, but such construction may enhance simplicity of assembly.

FIGS. 4-10 illustrate details of an alternative embodiment constructed according to principles of the instant invention, and generally indicated at 300. FIGS. 3-10 are scale drawings of a workable embodiment. Portions of retractor device 300 are structured to be assembled from sections cut from extruded stock, such as Aluminum. Illustrated device 300 includes a handle 302, an arm keeper 304, an end cap 306, and a hook 308. Operable extrusion profile shapes for the hook 308, end cap 306, arm keeper 304, and body 302 are illustrated in FIGS. 7-10, respectively. The components can be structured to have cooperating thicknesses to permit assembly using the same size rivet 310.

Figures 4, 5, 6, 7, 8, 9, 10:
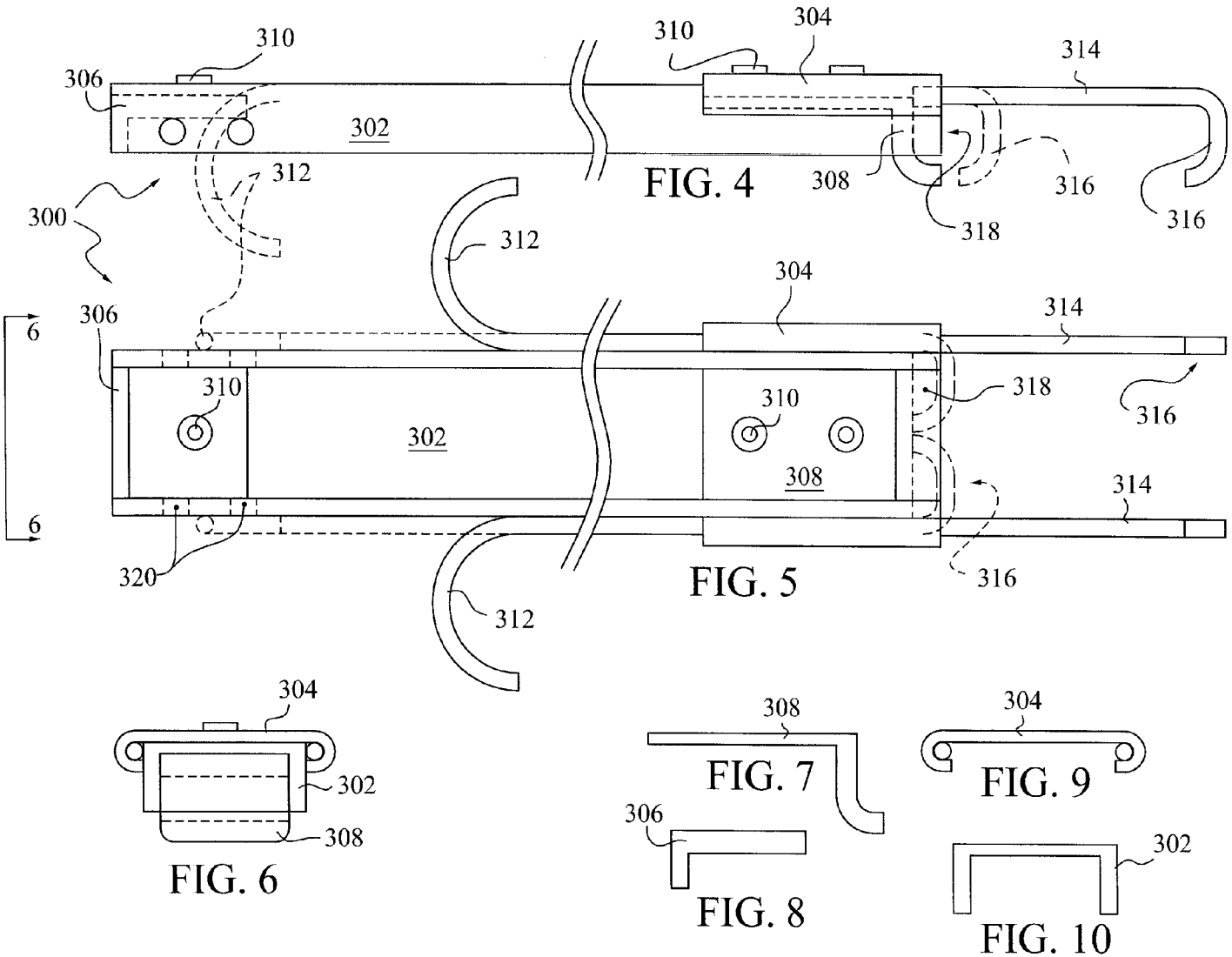
FIG. 4 is a side view in elevation of a second embodiment according to the invention.
FIG. 5 is a bottom view of the embodiment illustrated in FIG. 4.
FIG. 6 is an end view of the embodiment of FIG. 5, taken from section 6-6 and looking in the direction of the arrows.
FIGS. 7-10 illustrate extrusion profiles for components of the embodiment illustrated in FIGS. 4 and 5.

In FIGS. 4 and 5, triggers 312 of the retractor arms 314 are illustrated using dashed lines to indicate a stowed position, and solid lines to indicate a deployed position. In FIG. 4, the dashed indicator line points out a fully retracted position for remote finger 316, and the solid indicator line points out an extended position for finger 316. In FIG. 5, the remote fingers 316 are illustrated with dashed lines in a stowed position, and solid lines at an extended, deployed position. It is desirable to provide a socket 318 in which to stow remote fingers 316, and in which to hold a stem of a SLCD. A pair of lanyard holes 320 passing through rails of illustrated handle body 302 permit installation of a lanyard (not illustrated) operable to trap triggers 312 in a stowed position, and to suspend device 300 from a climber's rack or harness.

Figure 11:
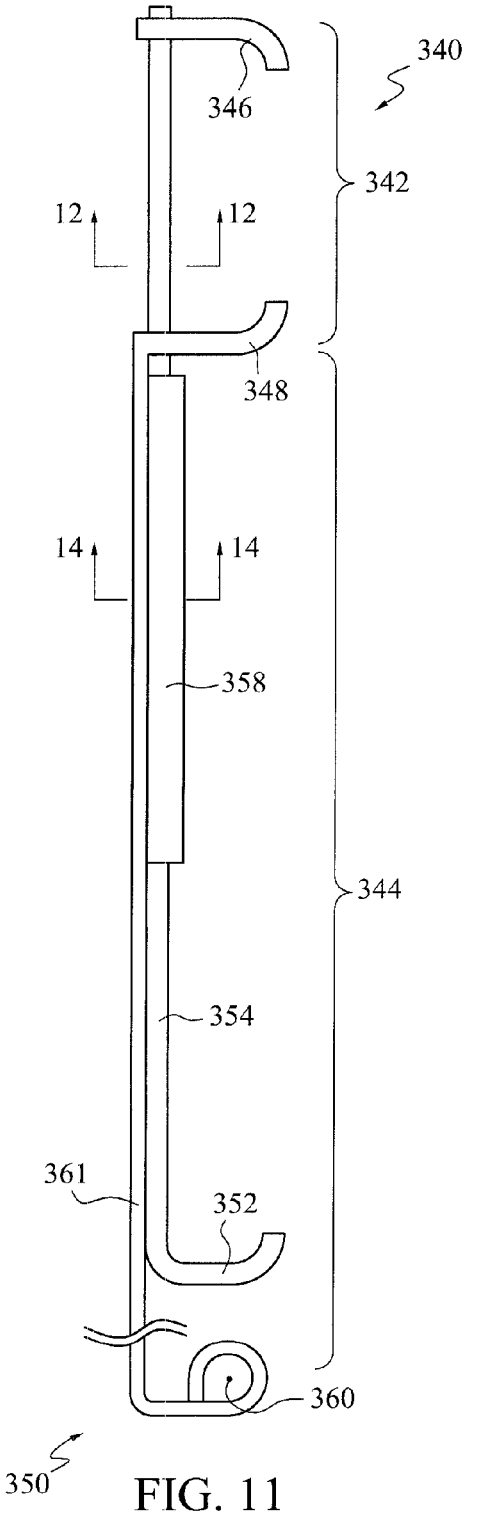
FIG. 11 is a side view of a third embodiment constructed according to prociples of the instant invention.
Figure 12:
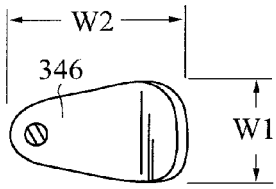
FIG. 12 is a section view taken through section 12-12 in FIG. 11, and looking in the direction of the arrows.
Figure 16:
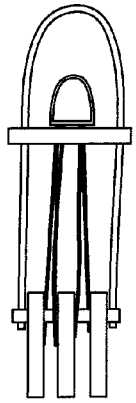
FIG. 16 illustrates a representative commercially available SLCD of the type having a center-pull arrangement.

A third embodiment constructed according to certain principles of the instant invention is illustrated in FIG. 11, and generally indicated at 340. Device 340 includes a retraction mechanism, generally indicated at 342, and a control interface, generally indicated at 344. The retraction mechanism includes a remote finger 346 arranged to cooperate with remote thumb 348. Control interface 344 includes pushing structure, generally indicated at 350, and trigger 352. A single retractor arm 354 connects trigger 352 and remote finger 346 so that manipulation of trigger 352 causes a corresponding movement of remote finger 346. Device 340 is particularly adapted to extract SLCDs of the type providing a center-pull arrangement, such as illustrated in FIG. 16. However, device 300 may also be used to extract other SLCDs having triggers adapted for convention two-finger gripping.

Figure 13:
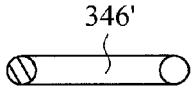
FIG. 13 is an alternative arrangement for structure illustrated in FIG. 12.
Figure 14:
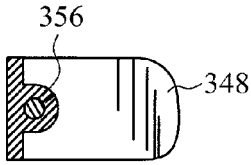
FIG. 14 is a section view taken through section 14-14 in FIG. 11, and looking in the direction of the arrows.

Arm 354 is disposed for reticulation along an axis inside bore 356 that extends through arm keeper 358. An operable arm 354 may be constructed in similar fashion to arms 204, 205, and from similar materials. Such arm may include the remote finger 346' structured as illustrated in FIG. 13. Alternatively, a remote finger 346 may be swaged, soldered, or welded to a distal end of arm 354. In the latter case, the remote finger can be structured to have a width W1 that is larger than a diameter of the arm 354. A width W1 may provide enhanced control of trigger retraction for a SLCD. In any case, it is preferred for the width W1 to be smaller than the width W2, to permit rotation of the remote finger 346 (or 346') to an orientation presenting a smaller profile to fit between the trigger of a stuck SLCD and a wall of the crack in which the SLCD is stuck.

Figure 15:
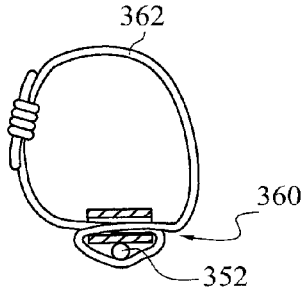
FIG. 15 is a section view through a lanyard attach point.

Desirably a lanyard hole 360 is formed in the proximal end of the handle 361. Therefore, a lanyard 362 may be threaded through hole 360 to trap trigger 352 of retractor arm 354 in a stowed position (see FIG. 15).

The devices illustrated in FIGS. 3 and 4-5 have mirror image left and right retractor arms that each can be rotated by about 180 degrees around their respective slide axes to permit moving their associated remote fingers from a storage position, past a trigger retraction position at about 90 degrees, and then through about 90 additional degrees to a bypass position. At the bypass position, the remote fingers are oriented approximately parallel to a wall of an assumed crack, and more favorably positioned for placement in a depth direction into the crack to bypass, and get behind, the SLCD's trigger. Once positioned behind the trigger of the SLCD, the remote fingers are then counter-rotated by about 90 degrees to a retraction position to interface with the SLCD's trigger.

Also, in the bypass position, the device's triggers are pointed in a helpful direction; protruding away from a possible dihedral wall or offset wall of the crack system. Therefore, the triggers are positioned for better access to, and manipulation by, the cleaner. At an SLCD trigger retraction position, the device's triggers are spaced apart from a dihedral or offset wall by at least about the thickness of the device's body, so a cleaner can place his/her fingertips into the trigger loops and operate the device as a hypodermic-like retractor.

It is within contemplation to form reticulated retraction devices having identical left and right triggers. Such triggers can be arranged to rotate by only about 90 degrees from a stowed position (same orientation as retraction position), to a bypass position. Such construction could reduce manufacturing complexity. An embodiment can be visualized by adding a second retractor arm in parallel and offset from the single retractor arm illustrated in FIG. 11. Therefore, the triggers would be actuatable in a position similar to the trigger of a gun. Unfortunately, such trigger positioning undesirably reduces the number of conformations of crack systems in which the device may be used.

It is also within contemplation for the device to be alternatively constructed to permit the device's triggers to be rotated to overlap across the center of the body at a storage or retraction position. A central opening may be disposed oriented along a length axis of the device to provide improved finger access to such triggers. Overlapped triggers could then be actuated together by a single finger. However, such configuration may reduce effectiveness of independent trigger actuation. Often, it is desirable to be able to retract each trigger of a two-retractor-arm device independently, effective to urge one or more cam element of an SLCD to move independently of other such elements.

While the invention has been described in particular with reference to certain illustrated embodiments, such is not intended to limit the scope of the invention. The present invention may be embodied in other specific forms without departing from its spirit or essential characteristics. The described embodiments are to be considered only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, adapted for use in retracting the trigger of a spring-loaded camming device used in the sport of rock climbing, comprising:

a retraction mechanism comprising a first remote finger and a remote thumb, said first remote finger being carried by an arm that is adapted to translate along a slide axis, said first remote finger also being configured and cooperatively arranged with said remote thumb to permit a first variable spacing therebetween in a first direction parallel to said slide axis; and a control interface adapted to receive input from a human hand and effective on said retraction mechanism to cause said variable spacing, wherein:

said arm is adapted to permit its rotation about said slide axis and through an angle comprising about 90 degrees, said apparatus further comprising:

a second remote finger disposed for actuation along a second axis substantially in parallel with said slide axis such that a second variable spacing may be established between said second remote finger and said remote thumb by structure associated with said control interface.

2. The apparatus of claim 1, wherein:

said second remote finger is adapted to permit its rotation about said second axis.

3. An apparatus operable to grab an item from within a crevice between two walls, comprising:

a retraction mechanism comprising a first remote finger and a remote thumb, said first remote finger having a length and a width orthogonal to said length, said width being smaller in size than said length, said retraction mechanism being arranged to permit translation of said first remote finger with respect to said remote thumb in a direction along a first axis, and for rotation of said first remote finger about said first axis and with respect to said remote thumb such that said first remote finger presents a reduced size to enhance passage of said first remote finger between said item and a wall of said crevice; and a control interface adapted to receive input from a human hand and coupled to said retraction mechanism operable to cause said translation responsive to said input, wherein said control interface comprises:

first trigger structure that is rotatable about said first axis through an angle comprising about 90 degrees, said first trigger structure being operable through a linkage to effect rotation of said first remote finger.

4. The apparatus of claim 3, further comprising:

a second remote finger disposed for translation, under effect of structure associated with said control interface, in a direction along a second axis disposed substantially in parallel with said first axis, such that a variable spacing may be established between said second remote finger and said remote thumb.

5. The apparatus of claim 4, wherein:

said second remote finger is adapted to permit its rotation about said second axis.

6. The apparatus of claim 3, wherein:

rotation of said first finger about said first axis may be effected through an angle comprising about 180 degrees.

7. The apparatus of claim 3, further comprising:

end cap structure adapted to interface with a structure of a user selected from the list comprising said user's thumb and said user's palm.

8. The apparatus of claim 4, further comprising:

a second trigger structure disposed for rotation about said second axis through an angle comprising about 90 degrees and operable through a linkage to rotate said second remote finger.

9. The apparatus of claim 8, wherein:

rotation of said second finger about said second axis may be effected through an angle comprising about 180 degrees.

10. The apparatus of claim 4, wherein:

said first remote finger and said second remote finger are structured for independent rotation.

11. The apparatus of claim 4, wherein:

said first remote finger and said second remote finger are structured for coupled rotation.

12. The apparatus of claim 4, wherein:

said first remote finger and said second remote finger are structured for independent translation in a length direction of said apparatus.

13. The apparatus of claim 4, wherein:

said first remote finger and said second remote finger are structured for coupled translation in a length direction of said apparatus.

14. An apparatus, comprising:

a handle having first and second ends spaced apart along a length axis, pushing structure being associated with said first end, and further comprising an arm keeper and a remote thumb associated with said second end;

a first retractor arm disposed in harmony with said arm keeper operably to permit displacement of said first retractor arm in a direction along a first slide axis disposed substantially parallel to said length axis, and to permit rotation of said first retractor arm about said first slide axis;

a first trigger being operably associated with a first end of said first retractor arm and a first remote finger being associated with a second end of said first retractor arm effective to couple motion of said first trigger to motion of said first remote finger; wherein:

said apparatus is configured and arranged to permit manipulation of said first trigger and said pushing structure by way of human hand input operably to displace said first remote finger relative to said remote thumb.

15. The apparatus of claim 14, wherein:

said arm keeper is adapted to resist rotation of said first retractor arm about first and second orthogonal Cartesian axes, and to permit rotation of said first retractor arm about a third Cartesian axis disposed orthogonal to said first and second Cartesian axes and substantially in parallel with said length direction.

16. The apparatus of claim 15, wherein:

said arm keeper is adapted to resist displacement of said first retractor arm along said first and second Cartesian axes, and to permit displacement of said first retractor arm along said third Cartesian axis.

17. The apparatus of claim 16, further comprising:

a second retractor arm disposed in harmony with said arm keeper operably to permit displacement of said second retractor arm in a direction along a second slide axis disposed substantially parallel to said length axis, and to permit rotation of said second retractor arm about said second slide axis;

a second trigger being operably associated with a first end of said second retractor arm and a second remote finger being associated with a second end of said second retractor arm effective to couple motion of said second trigger to motion of said second remote finger; wherein:

said apparatus is configured and arranged to permit manipulation of said second trigger and said pushing structure by way of human hand input operably to displace said second remote finger relative to said remote thumb.

18. The apparatus of claim 17, wherein:

a deployed length of said apparatus may be determined by a user in the field, and an overall stowed length of said apparatus is between about 5 inches and about 20 inches.

* * * * *